US009163441B1

(12) United States Patent
Taylor, III

(10) Patent No.: US 9,163,441 B1
(45) Date of Patent: Oct. 20, 2015

(54) EMERGENCY ENTRY PREVENTION SYSTEM

(71) Applicant: John Taylor, III, Prince Frederick, MD (US)

(72) Inventor: John Taylor, III, Prince Frederick, MD (US)

( * ) Notice: Subject to any disclaimer, the term of this patent is extended or adjusted under 35 U.S.C. 154(b) by 0 days.

(21) Appl. No.: 14/214,520

(22) Filed: Mar. 14, 2014

(51) Int. Cl.
*E05F 5/02* (2006.01)
*E05C 19/18* (2006.01)

(52) U.S. Cl.
CPC ..... *E05C 19/184* (2013.01)

(58) Field of Classification Search
CPC ..... E05C 19/184; E05F 5/02
USPC ..... 16/82, DIG. 7, DIG. 17, DIG. 21
See application file for complete search history.

(56) References Cited

U.S. PATENT DOCUMENTS 4,796,445 A * 1/1989 Norden, Jr. ..... 70/94
6,510,587 B2 * 1/2003 Urschel et al. ..... 16/83
6,720,874 B2 * 4/2004 Fufido et al. ..... 340/541
7,839,265 B2 * 11/2010 Picard et al. ..... 340/286.05
7,953,402 B2 * 5/2011 Carolan et al. ..... 455/419
8,764,071 B2 * 7/2014 Lanigan et al. ..... 292/92
2008/0115543 A1 * 5/2008 Lanigan et al. ..... 70/57.1
2008/0142587 A1 * 6/2008 Lanigan et al. ..... 235/382
2012/0154108 A1 * 6/2012 Sugaya ..... 340/5.1
2012/0204490 A1 * 8/2012 Lanigan et al. ..... 49/30

* cited by examiner

*Primary Examiner* — Roberta Delisle
(74) *Attorney, Agent, or Firm* — Leslie A. Thompson & Associates; Leslie A. Thompson

(57) ABSTRACT

An emergency entry prevention system which is particularly adaptable for use with double panic doors typically found in schools, movie theaters, and other public facilities. The system includes a base, support arms, and weighted central component designed to be removably secured in the channels of the strike bars of a conventional double panic door configuration to prevent the depression of the strike bars or external knobs upon the application of force. The system can also be modified with wireless and audio technology to effectuate audible and visual notification and facilitate location and communication during emergency situations like an unauthorized attempt at entry.

13 Claims, 2 Drawing Sheets

EMERGENCY ENTRY PREVENTION SYSTEM

REFERENCE TO RELATED APPLICATION

This application claims priority to Provisional Utility Patent Application No. 61/781,144, which is incorporated by reference herein.

FIELD OF THE INVENTION

The present invention relates generally to safety devices and more particularly to an improved emergency entry prevention system which is particularly adaptable for use with double panic doors typically found in schools, movie theaters, and other public facilities.

BACKGROUND OF INVENTION

Random mass shootings have long accompanied the proliferation of firearms around the world. In 2012, Americans witnessed a rash of random fatal shootings at schools, theaters, and workplaces alike. There were sixteen (16) random mass shootings last year alone in the United States that tragically and needlessly claimed the lives of 88 people. None more upsetting and heart wrenching than the 26 lives lost, which included 20 children, at the hands of a random shooter at Sandy Hook Elementary School in Newtown, Conn. on Dec. 14, 2012. The safety of the occupants of public and private facilities is paramount and innovation is needed to secure said facilities at every level.

In many of the aforementioned buildings, double panic doors are commonly used to quickly accommodate the ingress and egress of the general public in high volumes. The double panic doors are configured to open by applying force to panic bars or strike bars, which are generally disposed midway on the inside between the top and bottom of the respective doors, thus causing the strike bars to urge inwardly and release the locking means for the door-latch system. These double panic doors can also be locked and unlocked from the outside using a variety of systems including, but not limited to, biometric readers, conventional keys, and card readers. This conventional door system has a conventional key lock and door handle arrangement on the outside surface of the double panic door configuration.

Double panic doors can be a liability in certain situations as intruders have learned how to circumvent or overwhelm these door configurations. Schools and other public/private institutions have seen an increase of criminal acts that could be abated or mitigated. There exists a need to improve the security of double panic doors to prevent unauthorized entry and afford police and authorities more time to respond to emergency situations where every second could be the difference between life and death.

It is to be understood that both the foregoing general description and the following detailed description are exemplary and explanatory only and are not restrictive of the invention as described. The accompanying images, which are incorporated in and constitute part of the specification, illustrate various embodiments of the invention and together with the general description, serve to explain the principles of the invention.

BRIEF DESCRIPTION OF THE PREFERRED EMBODIMENTS

This invention relates to safety devices and more particularly to an improved emergency entry prevention system which is particularly adaptable for use with double panic doors typically found in schools, movie theaters, and other public facilities. The emergency entry prevention system of the present invention is depicted generally in FIGS. 1-2.

Figure 3:
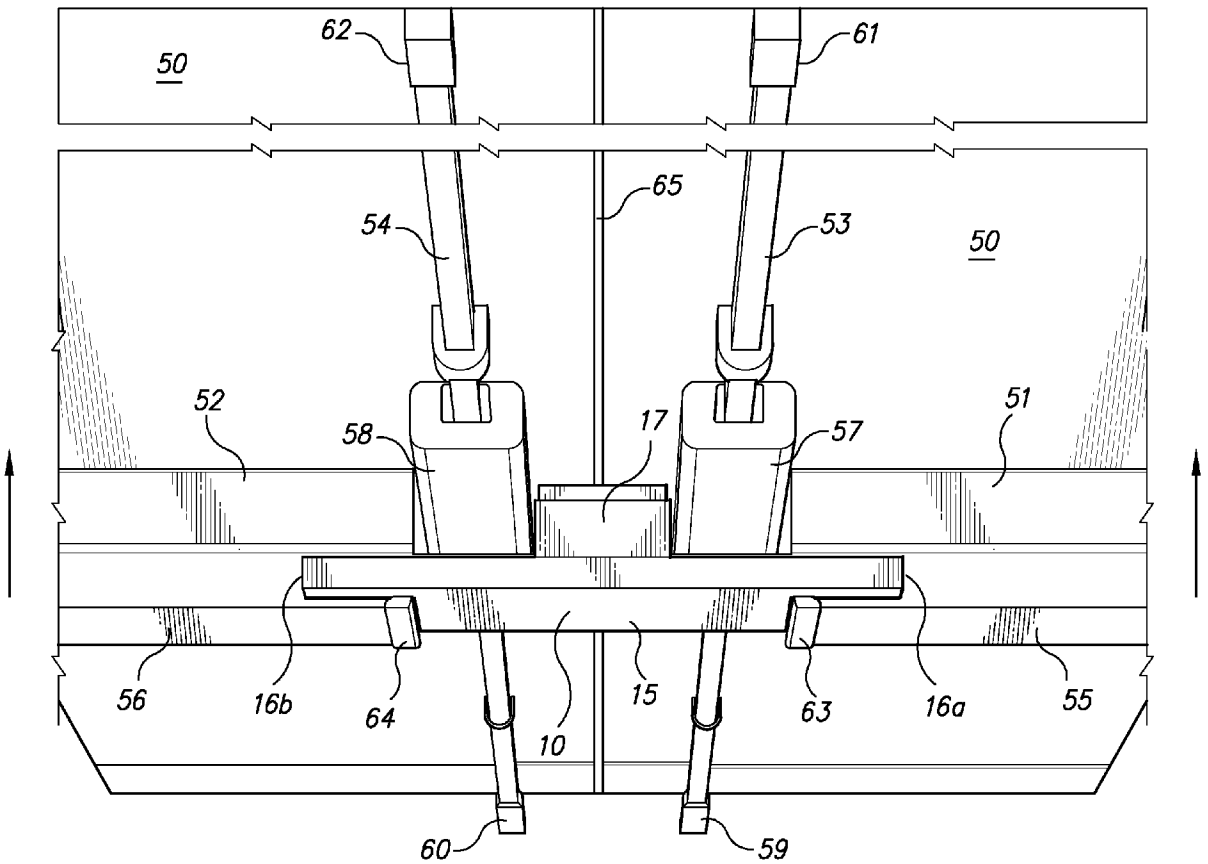
FIG. 3 is a digital image of a perspective view of the inside of a conventional double panic door configuration in a closed position with the emergency entry prevention system installed.

Referring to FIG. 3, the inside surface 50 of a conventional double panic door configuration has a baseplate 51,52 covered by a housing and operatively coupled to the latch rod mechanism. A push bar or strike bar 55,56 is oriented with the baseplate 51,52 so that it can move between a first outward position and a second inward position upon the application of force. The strike bar 55,56 may extend the entire length of the baseplate 51,52 or said strike bar 55,56 may only extend a portion of the length of the baseplate 51,52. An end cap 63,64 may be used to discourage any lateral movement of the strike bar 55,56.

The latching mechanism 57,58 typically includes a vertical housing mounted flush to the door and a horizontal housing extending thusly from the vertical housing. The horizontal housing of the latching mechanism 57,58 encloses a primary link carriage that retracts in response to the movement of the strike bar 55,56. The primary link carriage is usually coupled to both the latch bolt and a secondary bolt. The latch bolt is functionally coupled to the horizontal housing by conventional means.

As seen in FIG. 3, the latching mechanism 57,58 is used to actuate vertical rods 53,54. This style of panic door is used commonly in conjunction with double doors having a strike 61,62 in the header and a strike 59,60 in the floor. The respective strike bars 55,56 are mounted to the door along and coupled with a dogging mechanism. These elements operate as described above. A central coupling in the latching mechanism 57,58 is used to translate the motion of the strike bar 55,56 to a pair of vertical rods 53,54. A first vertical rod 53,54 operates the latching mechanism 61,62. Latching mechanisms 61,62 are well known and many configurations exist. As the first vertical rod 53,54 moves upward, the latching mechanism 61,62 is urged to retract the latch in response to the upward movement of said rod 53,54. The second vertical rod 53,54 is arranged to orient a peg latch 59,60. The functional coupling of the vertical rods 53,54 and latching mechanism when the strike bar 55,56 is inwardly urged by force translates to the retraction of the latch 61,62 and the peg 59,60, thus permitting the double panic doors to be opened. Preventing the depression of the inside strike bar(s) 55,56 when the outside door handle, not shown, or strike bar 55,56 is engaged and maintaining the double panic doors in a locked orientation is accomplished with the present invention.

Figure 1:
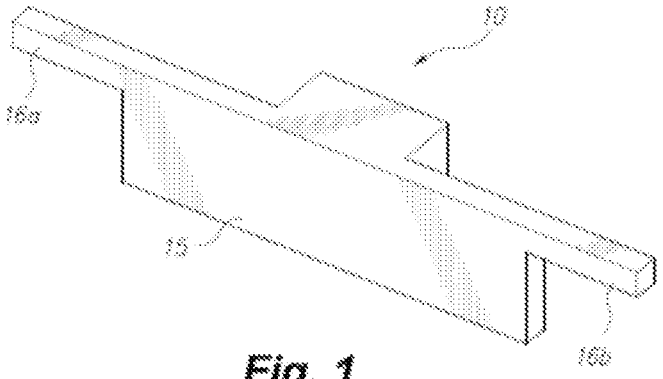
FIG. 1 is a digital image of a perspective view of the emergency entry prevention system of the present invention.
Figure 2:
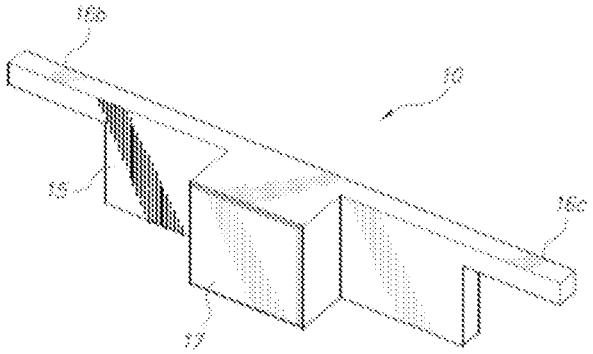
FIG. 2 is a digital image of a perspective view of the emergency entry prevention system of the present invention.

As seen in FIGS. 1-2, the emergency entry prevention system 10 of the present is a rigid unitary device that can be specifically adapted for speedy installation on a myriad of double panic door configurations. In the preferred embodiment, the device 10 is made from durable and non-malleable materials or metals, such as steel or cast iron, having considerable density and not prone to succumb to the application of force. The device 10 is ideally manufactured from a single mold, thus ensuring the integrity of the construction. Alternatively, the device may be assembled from a plurality of components via a number of conventional methods, such as welding.

The device 10 comprises a generally rectangular base 15 having an appreciable thickness. The length of the base 15 may vary depending on the distance between the inner endpoints of the corresponding strike bars 55,56 on the respective doors 50 as seen in FIG. 3. Two support arms 16*a*,16*b* extend outwardly from the opposing upper sidewalls of the base 15 in a flush planar arrangement and having the same thickness of the base 15. The thickness of the base 15 and support arms 16*a*,16*b* will vary according to the type and clearance width of the strike bars 55,56 employed by the double panic doors. A more detailed explanation is forthcoming.

The base 15 is also defined by a protruding central component 17 integrally disposed in a perpendicular arrangement in the center of the base. The central component 17 features a generally block-like configuration. As seen in FIG. 3, if the molding astragal 65 of the double panic doors is comprised by an intruder, the central component 17 primarily prevents tampering of the vertical housings 57,58 of the latching mechanism(s) via a rigid elongate from outside the door. Secondarily, the central component 17 is weighted, thus requiring more force for selective removal by a user or unauthorized entry an intruder.

As seen in FIG. 3, the emergency entry prevention system 10 of the present invention is easily installed in emergency and non-emergency situations. The steel embodiment depicted in FIG. 3 adds a stealth quality that allows the device 10 to inconspicuously appear to be a designed component of the double panic doors. A user can quickly install or remove the system 10 without the need for tools or intervening assistance. When the device 10 is installed, the base 15 will fit snugly between the endpoints of the two opposing strike bars 55,56 in a suspended arrangement as a result of the support arms 16*a*,16*b* resting atop the corresponding clearance width of the channel defined between the outer flanges of the strike bars 55,56 and housings of the baseplates 51,52 fixedly attached to the respective doors 50. The support arms 16*a*,16*b* are of sufficient height and width such that the application of force on either side of the doors occludes the depression of the engaged strike bars 55,56, thus maintaining the doors in a secure and locked position.

The central component 17 protrudes outwardly from the base 15 and terminates flush with the section of the doors between the vertical housings 57,58. The central component 17 is designed for snug placement between the vertical housings of the latching mechanism(s) 57,58. Once the emergency situation has been abated and calm has been restored, the user can readily detach the device 10 from the channel and strike bars 55,56 by engaging the base 15 and lifting the device 10.

The dimensions of the base 15, support arms 16*a*,16*b*, and central component 17 of the emergency entry prevention system 10 can be modified to accommodate any double panic door configuration without departing from the scope of this invention.

An alternative embodiment of the emergency entry prevention system 10 teaches the inclusion of a motion/vibration sensor in the central component 17. When the device 10 is installed, the internal motion/vibration sensor is ideally calibrated to detect the application of force or vibrations associated with an authorized attempt to gain access to the building. The sensor is electronically coupled to a digital controller that activates a visual and/or audible alarm disposed atop the central component 17. Once the system is activated, the digital controller electronically communicates with a smart external interface on the outer wall of the base 15 that permits the user to selectively determine the number of forced entry attempts before the alarm is actuated. The default setting activates the alarm immediately upon detection of force, thus eliminating the need for a user to remember to adjust the settings in an emergency situation.

For older buildings without a smart alarm system, another embodiment of the invention teaches the inclusion of a wireless transceiver/transponder/global positioning system (GPS) integrally housed in the central component 17. When the device 10 is installed, the internal motion/vibration sensor is ideally calibrated to detect the application of force associated with an attempt to gain unauthorized entry to a building. The sensor is electronically coupled to a digital controller that activates a transceiver/transponder that communicates wirelessly to alert the police and building officials of an authorized attempt to gain access to the building. Once the system is activated, the digital controller electronically communicates with a smart external interface on the outer wall of the base 15 that permits the user to selectively determine the number of forced entry attempts before the wireless alert is sent. The default setting alerts the authorities immediately upon detection of force, thus eliminating the need for a user to remember to adjust the settings in an emergency situation. The GPS allows police and school officials to quickly determine the location of the entry attempt and direct building inhabitants away the area in question. Alternatively, this embodiment can be adapted with BLUETOOTH® technology to facilitate "pairing" or wirelessly coupling the device to designated multimedia devices for shortened response times and enhanced functionality.

In the unlikely event the emergency entry prevention system 10 is compromised and dislodged or removed by an intruder, another embodiment of the invention teaches the inclusion of a replaceable or refillable integral canister of tear gas stored in the central component 17. When the device 10 is installed, the internal motion/vibration sensor is ideally calibrated to detect the application of force or vibration associated with an attempt to gain unauthorized entry to a building. The sensor is electronically coupled to a digital controller that effectuates the puncturing of the canister and the immediate and rapid dispersal of tear gas (or non-toxic smoke) through a port in the upper surface of the central component to discombobulate the intruder and/or obstruct the line of sight of an intruder, thus thwarting or preventing entry to the building and/or preventing a shooter from clearly targeting the occupants of the building. Once the system is activated, the digital controller interprets data from the sensor to determine when the device 10 has been removed.

The aforementioned embodiments are not mutually exclusive and can all be fully integrated into the emergency entry prevention system 10. It is within the scope of the invention, for instance, to permit a police dispatcher to issue verbal warnings to abort unauthorized entry attempts through the speaker of the integral audible alarm, housed in the central component 17, once the transceiver/transponder wirelessly communicates an alert. Integrated BLUETOOTH® technology will allow a user to remotely program the digital controller without the external smart user interface or terminate the alarm.

Thus, it may be seen that the emergency entry prevention system 10 of the present invention has important advantages over the known prior art structures in that such a safety device may be rapidly and easily installed upon double panic door configurations as to reactively prevent unauthorized access to a building within which the devices 10 are installed. The device 10 is removably secured upon the door locking assemblies in a manner not conducive to casual removal.

The alternative embodiments feature an internal battery source housed in the central component 17. The battery source may feature disposable batteries or rechargeable batteries. Disposable batteries will be selectively introduced or removed via an access door to the battery compartment. The rechargeable battery version of the device will feature a tethered arrangement with a conventional electrical outlet to replenish internal battery power.

Once the emergency situation has been abated and calm has been restored, the user can remove the installed device 10 and store the device 10 in a readily accessible place or designed storage case and/or recharge/replenish expended components of the device 10 before storage.

Obviously, many modifications and variations of the present invention are possible in light of the above teachings. It will be appreciated by those skilled in the art that the device 10 can be constructed from any suitable material and is adaptable to many colors, prints, and themes. In the preferred embodiment, the device 10 is rigid to promote durability and enhance the protective qualities of the instant invention. The device can alternatively be adapted with a flexible or semi-rigid housing. Moreover, disposable and short-term use embodiments of the device are within the scope of the present invention.

While the present invention has been explained by a detailed description of a preferred embodiment, it is understood that various modifications and substitutions can be made with respect to the preferred embodiment or embodiment described herein within the scope of the present invention and its equivalents. It will be apparent; however, that variations and modifications may be made by those skilled in the art to the disclosed embodiments of the invention, with the attainment of some or all of its advantages and without departing from the spirit and scope of the present invention.

The invention claimed is:

1. An emergency entry prevention system retrofittable to conventional double panic doors comprising:

a) a base having a generally rectangular configuration with a first side and a second side, b) a first support arm extending outwardly from the first side of the base, c) a second support arm extending outwardly from the second side of the base, and d) a central component having a generally block configuration disposed in the midpoint of the base and protruding therefrom, and arranged in a unitary component designed to be supported by and removably secured to the respective strike bars of a conventional double panic door system.

2. The emergency prevention system according to claim 1 where the base, first support arm, and second support arm are constructed to have appreciable thickness.

3. The emergency prevention system according to claim 1 where the central component is weighted to prevent inadvertent movement or dislodging of the emergency prevention system once installed in a conventional double panic door system.

4. An emergency entry prevention system retrofittable to conventional double panic doors comprising:

a) a base having a generally rectangular configuration with a first side and a second side, b) a first support arm extending outwardly from the first side of the base and removably received therein, c) a second support arm extending outwardly from the second side of the base and removably received there, and d) a central component having a generally block configuration disposed in the midpoint of the base and protruding therefrom where the base, support arms, and central component are individual components of varying dimensions such that the support arms and central component can be mechanically coupled to the 25 base to accommodate installation on double panic door system of varying dimensions.

5. The emergency prevention system according to claim 4 where the base, first support arm, and second support arm are constructed to have appreciable thickness.

6. The emergency prevention system according to claim 4 where the central component is weighted to prevent inadvertent movement or dislodging of the emergency prevention system once installed in a conventional double panic door system.

7. An emergency entry prevention system retrofittable to conventional double panic doors comprising:

a) a base having a generally rectangular configuration with a first side and a second side, b) a first support arm extending outwardly from the first side of the base, c) a second support arm extending outwardly from the second side of the base, and d) a central component having a generally block configuration disposed in the midpoint of the base and protruding therefrom, e) an internal motion/vibration sensor, f) a wireless communication system, g) a programmable controller, h) an audible alert system, i) a visual alert system, j) a global positing system, k) a power source, l) graphical user interface, m) a control panel, and arranged in a unitary component designed to be supported by and removably secured to the respective strike bars of a conventional double panic door system.

8. The emergency prevention system according to claim 7 where the base, first support arm, and second support arm are constructed to have appreciable thickness.

9. The emergency prevention system according to claim 7 where the central component is weighted to prevent inadvertent movement or dislodging of the emergency prevention system once installed in a conventional double panic door system.

10. The emergency prevention system according to claim 7 where the power source comprises rechargeable batteries.

11. The emergency prevention system according to claim 7 where the wireless communication system comprises wireless technology standard for exchanging data over short distances.

12. The emergency prevention system according to claim 7 where the programmable controller can determine when to engage audible and visual alerts and when wirelessly communicate with police in the event of an emergency.

13. The emergency prevention system according to claim 7 where the central component contains a dispensable canister of tear gas or the like to be disseminated in the event the programmable controller deems there is an attempt at unauthorized entry.

* * * * *